US007681826B2

(12) United States Patent
Whitney

(10) Patent No.: US 7,681,826 B2
(45) **Date of Patent: *Mar. 23, 2010**

(54) CHALK LINE DEVICE

(75) Inventor: Hamilton Sean Michael Whitney, Cornelius, NC (US)

(73) Assignee: Irwin Industrial Tool Company, Huntersville, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/869,769

(22) Filed: Oct. 10, 2007

(65) Prior Publication Data

US 2008/0040939 A1 Feb. 21, 2008

Related U.S. Application Data

(63) Continuation of application No. 11/034,183, filed on Jan. 12, 2005, now Pat. No. 7,311,283.

(60) Provisional application No. 60/640,520, filed on Dec. 31, 2004.

(51) Int. Cl.
*B65H 75/30* (2006.01)

(52) U.S. Cl. ..... 242/394; 242/395.1; 33/414

(58) Field of Classification Search ..... 242/394, 242/395.1, 396.1, 405; 33/414
See application file for complete search history.

(56) References Cited

U.S. PATENT DOCUMENTS

| | | | | |
|---|---|---|---|---|
| 627,057 | A | | 6/1899 | Gavin |
| 1,551,474 | A | | 8/1925 | Fassett |
| 3,311,319 | A | | 3/1967 | Campbell |
| 3,438,595 | A | | 4/1969 | Brown et al. |
| 4,272,036 | A | | 6/1981 | Watermann |
| 4,756,087 | A | | 7/1988 | Sing |
| 4,813,145 | A | | 3/1989 | Josey, Jr. et al. |
| 4,930,719 | A | * | 6/1990 | Sehl ..... 242/394 |
| 5,377,626 | A | | 1/1995 | Kilsby et al. |
| 5,470,029 | A | | 11/1995 | Dufour |
| 5,471,761 | A | | 12/1995 | Cheng |
| 5,683,055 | A | | 11/1997 | Dufour |
| 5,822,874 | A | | 10/1998 | Nemes |

(Continued)

FOREIGN PATENT DOCUMENTS

EP 0476802 A1 4/1991

(Continued)

OTHER PUBLICATIONS

PCT International Preliminary Report on Patentability for PCT/US05/047060 dated Jul. 12, 2007.

(Continued)

*Primary Examiner*—Sang Kim
(74) *Attorney, Agent, or Firm*—Dennis J. Williamson; Moore & Van Allen, PLLC

(57) ABSTRACT

One embodiment of the invention provides a chalk line device having a helical gear and an improved locking assembly. The locking assembly comprises a first lock member having a lock button. The locking assembly also comprises a second lock member including an opening to lockingly engage the first lock member and having a plurality of teeth at one end disposed adjacent one of the helical gears used in this embodiment. The second lock member engages with the helical gear in response to a movement of the lock button member.

12 Claims, 5 Drawing Sheets

U.S. PATENT DOCUMENTS

| | | | | |
|---|---|---|---|---|
| 5,920,997 | A | 7/1999 | Girtman | |
| 6,082,651 | A | 7/2000 | Kemp, III | |
| 7,311,283 | B2 * | 12/2007 | Whitney | 242/394 |
| 2003/0221325 | A1 | 12/2003 | Dekort | |

FOREIGN PATENT DOCUMENTS

| | | | |
|---|---|---|---|
| WO | 0002444 | A1 | 1/2000 |

OTHER PUBLICATIONS

PCT International Search Report for PCT/US04/47060 dated Oct. 16, 2006.

PCT Written Opinion for PCT/US05/047060 dated Oct. 16, 2006.

European Patent Office, Search Report, Dec. 16, 2008.

* cited by examiner

CHALK LINE DEVICE

PRIORITY CLAIM

This application is a continuation of U.S. patent application Ser. No. 11/034,183, filed Jan. 12, 2005, now U.S. Pat. No. 7,311,283, which claims the benefit of U.S. Provisional Application No. 60/640,520, filed Dec. 31, 2004 under 35 U.S.C. §119(e). The disclosure of the above applications are incorporated herein by reference.

BACKGROUND OF THE INVENTION

1. Field of Invention

The present invention relates to a chalk line device. More particularly, the present invention relates to a chalk line device employing a helical gear and having an improved locking assembly.

2. Description of the Prior Art

Chalk line devices are well known and widely used in various construction applications. Typically, chalk line devices use a retractable line covered with chalk powder to mark a straight line on a surface. To extend or retract the line, a gear or similar device may be used with the chalk line device. For example, the gear is connected to a spool where the chalk line is wound. When the chalk line is extended or retracted, the gear rotates in cooperation with the spool. When the extended chalk line needs to be locked, the gear and/or the spool are kept stationary.

Typically, spur gears have been used with conventional chalk line devices. However, spur gears produce rotation that is noisy and not smooth. In addition, conventional locking assemblies for locking the extended chalk line tend to damage the spool. Furthermore, conventional locking assemblies usually require additional parts, which make the assemblies more expensive. Accordingly, a chalk line device that overcomes these drawbacks is needed.

BRIEF SUMMARY OF THE INVENTION

One embodiment of the invention provides a chalk line device employing a helical gear. The helical gear runs more smoothly and can minimize noise during operation.

Another embodiment of the invention provides a chalk line device having a clutch mechanism. The chalk line device comprises a clutch and a clutch button member operably connected to the clutch. One of the helical gears used in this embodiment interlock with the clutch. A rotatable handle is attached to the clutch button member. When the clutch interlocks one of the helical gears, the handle rotates the helical gear. By pressing the clutch button member downwardly, the clutch may be disengaged from the helical gears.

Another embodiment of the invention further provides a chalk line device having an improved locking assembly. The locking assembly comprises a first lock member that has a lock button, a body member and a pair of legs. The locking assembly also comprises a second lock member including an opening to lockingly engage the first lock member and having a plurality of teeth at one end. The second lock member engages with one of the helical gears in response to a movement of the first lock member.

DETAILED DESCRIPTION OF THE INVENTION

Figure 1A:
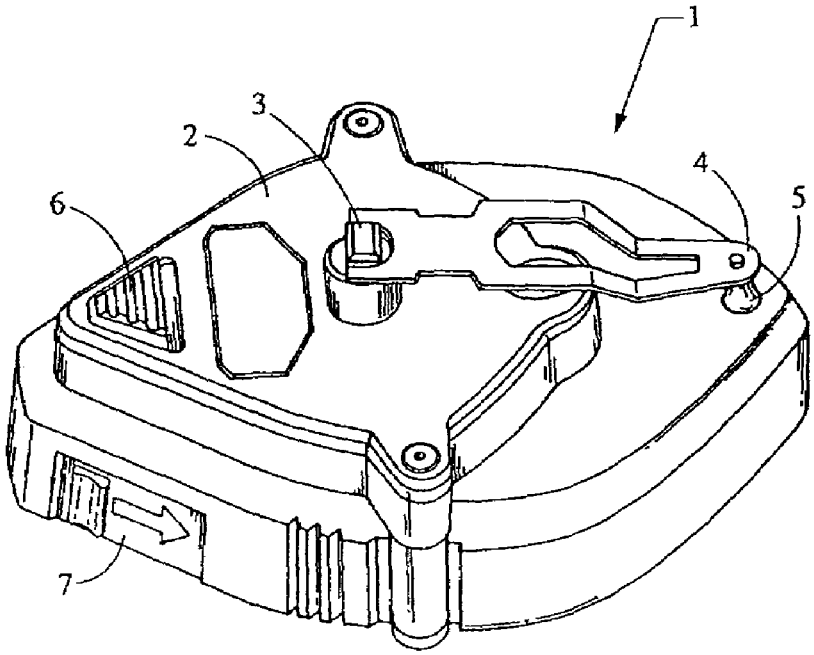
FIG. 1A is a perspective view of one embodiment of a chalk line device.
Figure 1B:
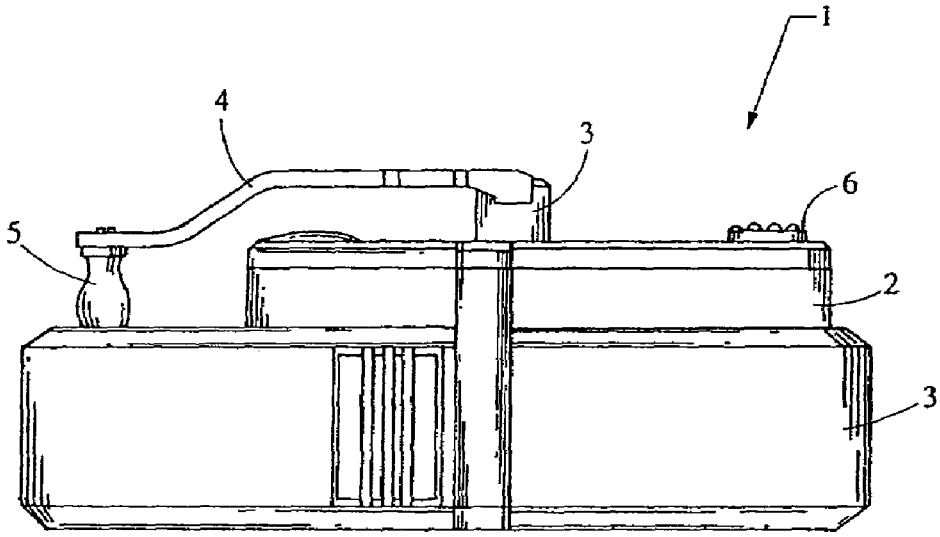
FIG. 1B is a side view of the chalk line device depicted in FIG. 1A.

FIGS. 1A and 1B show one embodiment of a chalk line device. A chalk line device 1 comprises a housing 10. A rotatable handle 4 is attached to a clutch button 3. The handle 4 is placed on a handle securing member 5 while it is not in use as shown in FIG. 1A. When it is in use, the handle 4 is lifted upwardly and rotated radially. The chalk line device 1 also comprises a lock button 6 and a chalk window or door 7 that slides back and forth.

Figure 2A:
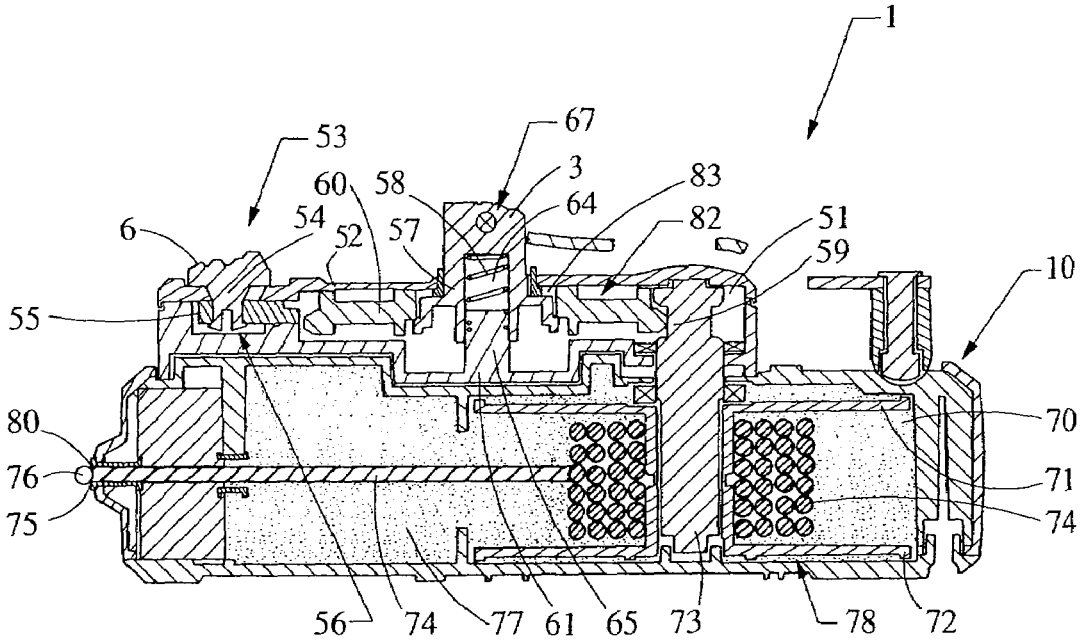
FIG. 2A is a cross sectional view of an interior structure of the chalk line device shown in FIG. 1A.

FIG. 2A shows an interior structure of the chalk line device 1. The housing 10 of the chalk line device 1 has a hollow interior space that includes a gear cavity 51 and a chalk cavity 70. The gear cavity 51 is enclosed by an upper housing member 52 and a gear rest 61. The gear cavity 51 houses a locking assembly 53 and a gear assembly 82. The locking assembly 53 includes a first lock member 54 having a lock button 6 and a second lock member 55. The locking assembly 53 is located adjacent a front end of the chalk line device 1 in FIG. 2A, but it may be located adjacent a rear end. A detailed explanation of the structure and the operation of the lock assembly 53 will be provided in conjunction with a description of FIGS. 3 and 4.

Figure 2B:
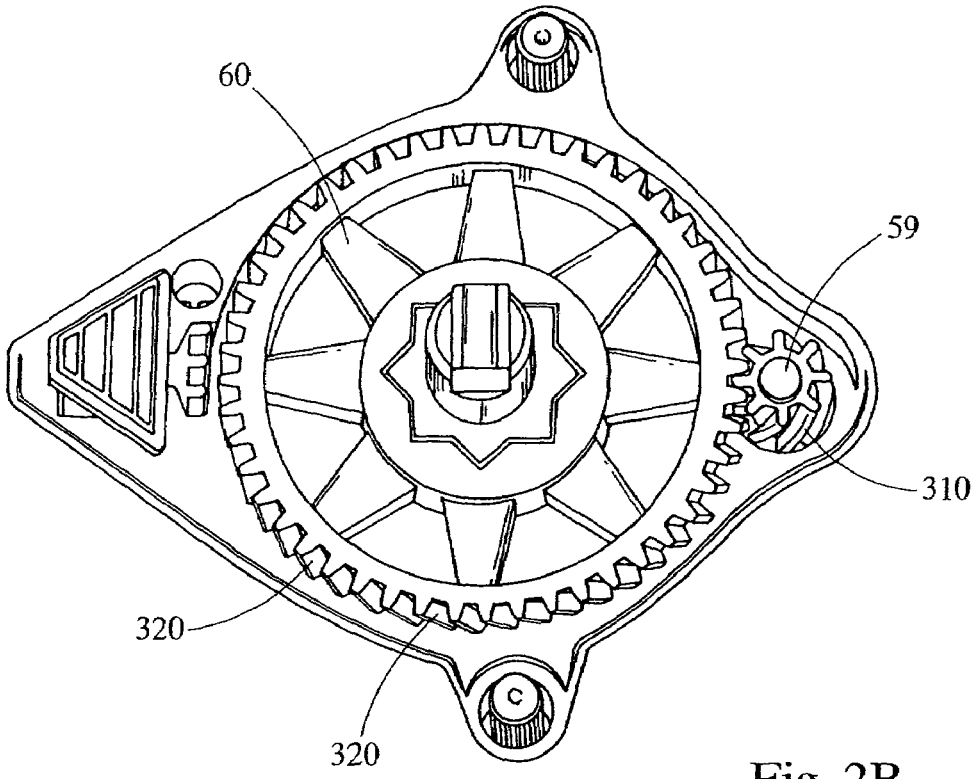
FIG. 2B is a detailed view of a gear assembly.

The gear assembly 82 includes a first gear 59 and a second gear 60. The second gear 60 is placed on the gear rest 61. A shaft 65 is extended vertically from the gear rest 61. The first and the second gears 59, 60 meshingly engage with each other. The first gear 59 and the second gear 60 are helical gears. The first and the second gears 59, 60 have a plurality of teeth 310, 320 that are cut at an angle from the gear faces as shown in FIG. 2B. The helical gears 59, 60 start engaging with each other as a tooth of the first gear 59 contacts a corresponding tooth of the second gear 60 at one end. Two teeth gradually become in a full contact as the gears 59, 60 rotate. The helical gears 59, 60 get engaged at their teeth or their sides. Due to this gradual engagement, the first and the second gears 59, 60 run more smoothly and the teeth of the gears 59, 60 tend to last longer, as opposed to those of conventional spur gears. Further, the first and the second gears 59, 60 rotate quietly during operation.

The first gear 59 and the second gear 60 are designed to have a predetermined gear ratio, m:n. For example, m:n may be 1:6. With the gear ratio, 1:6, a single turn of the second gear 60 corresponds to six turns of the first gear 59. The second gear 60 has relatively a larger diameter than the first gear 59. In one embodiment, the diameter of the second gear 60 is five times as large as that of the first gear 59. For example, the diameter of the second gear 60 may be 2.076" as opposed to 0.409", the diameter of the first gear 59. A length of the chalk line device 1 is configured to be at least twice as long as the diameter of the second gear 60. For example, the length of the chalk line device 1 may be 5". The foregoing dimensions are by way of example and various dimensions are possible.

As shown in FIG. 2A, the second gear 60 has a central opening 83 disposed at its center. Through the central opening 83, the second gear 60 interlocks with the clutch 57. The central opening 83 has star shape as shown in FIG. 2B, but other shapes are available. The clutch 57 is made of plastic piece having star shape. The size and shape of the clutch 57 correspond to those of the central opening 83. The clutch button 3 and the clutch 57 are integrally formed in a clutch housing 67. The clutch housing 67 has an inner channel, which is formed vertically between the clutch button 3 and the clutch 57 as shown in FIG. 2A. The inner channel 64 includes coil springs 58 disposed therein. The coil springs 58 have a cylindrical shape and disposed around a wall of the channel 64. When the clutch button 3 is pressed downwardly, the clutch 57 is pushed down on the shaft 65 through the inner channel 64. As a result, the clutch 57 is disengaged from the second gear 60. Gradually, the clutch 57 returns to its original position because of the coil spring 58. The coil spring 58 pushes up the clutch housing 67 so that the clutch 57 remains interlocked with the second gear 60.

The chalk cavity 70 of the housing 10 houses a spool 78 and a chalk line 74. The spool 78 includes a top plate 71 and a bottom plate 72. The first gear 59 has a shaft 73 that runs through the center of the spool 78 as shown in FIG. 2A. This results in a cooperative movement between the first gear 59 and the spool 78. Specifically, rotation of the first gear 59 leads to rotation of the spool 78 and vice versa, because the first gear 59 and the spool 78 share the shaft 73. Normally, the shaft 73 runs through the center of the spool 78 and the chalk line 74 is wound on the spool 78. The chalk line 74 has a first end secured to the spool 78 and a second end 75 disposed outside of the housing 10 via an aperture 80. The second end 75 of the line 74 is attached to a line hook 76, which allows the user to grasp the chalk line 74 and extend it outside of the housing 10. The line 74 is generally covered by chalk powder 77. The chalk powder 77 is introduced into the chalk cavity 70 through the chalk window 7 (see FIG. 1A). The chalk powder 77 does not deteriorate the operation of the gear assembly 82 and the locking assembly 53 because the gear rest 61 prevents the chalk powder 77 from entering into the gear cavity 51.

Referring to FIGS. 1 and 2, an operation for retracting the chalk line 74 is explained. As previously described, the clutch 57 remains interlocked with the second gear 60 through the central opening 83. The coil spring 58 facilitates such engagement between the clutch 57 and the second gear 60 by pushing up the clutch 57 where no pressure is applied on the clutch housing 67 via the clutch button 3. To retract the chalk line 74, the handle 4 is rotated. Because the handle 4 is connected to the clutch 57 through the clutch button 3 and the clutch 57 interlocks the second gear 60, the handle 4 rotates the second gear 60. Consequently, the first gear 59 engaging the second gear 60 and the spool 78 connected to the first gear 59 through the shaft 73 rotate. The user can retract the chalk line 74 by rotating the handle 4.

On the other hand, when the second gear 60 is not engaged with the clutch 57, the handle 4 does not rotate the second gear 60, the first gear 59 and the spool 78. Especially while the line 74 is pulled out, the handle 4 does not need to spin. The user can avoid the spinning of the handle 4 by having the clutch 57 disengaged from the second gear 60. As described above, the clutch 57 remains interlocked with the second gear 60 because the coil spring 58 pushes up the clutch 57. Pressing the clutch button 3 leads to compression of the coil spring 58 and the clutch 57 is disengaged from the second gear 60. After the line 74 is pulled out, the user does not impose any pressure on the clutch 57 and the clutch button 3. The coil spring 58 returns to an uncompressed state. Accordingly, the spring 58 biases the clutch 57 upwardly so that the clutch 57 becomes interlocked with the second gear 60.

Alternatively, the line retraction operation may be performed in a manner that the clutch 57 becomes interlocked with the second gear by pressing the clutch button 3 down. In this embodiment, the clutch 57 remains disengaged from the second gear 60. During the retracting operation, the user presses the button 3 downwardly and the clutch 57 and the second gear 60 become engaged. A spring may be used to push the clutch 57 up to release it from the second gear 60 after completing the line retraction.

As described previously, the first gear 59 and the second gear 60 are designed to have the gear ratio m:n, for example, 1:6. When a user rotates the second gear 60 by using the handle 5, the first gear 59 rotates six times corresponding to the single rotation of the second gear 60. The first gear 59 and the spool 78 share the shaft 73, and therefore, the spool 78 also rotates six times per a single turn of the second gear 60. This makes it possible for a user to retract the chalk line 74 more easily and swiftly.

Figure 3:
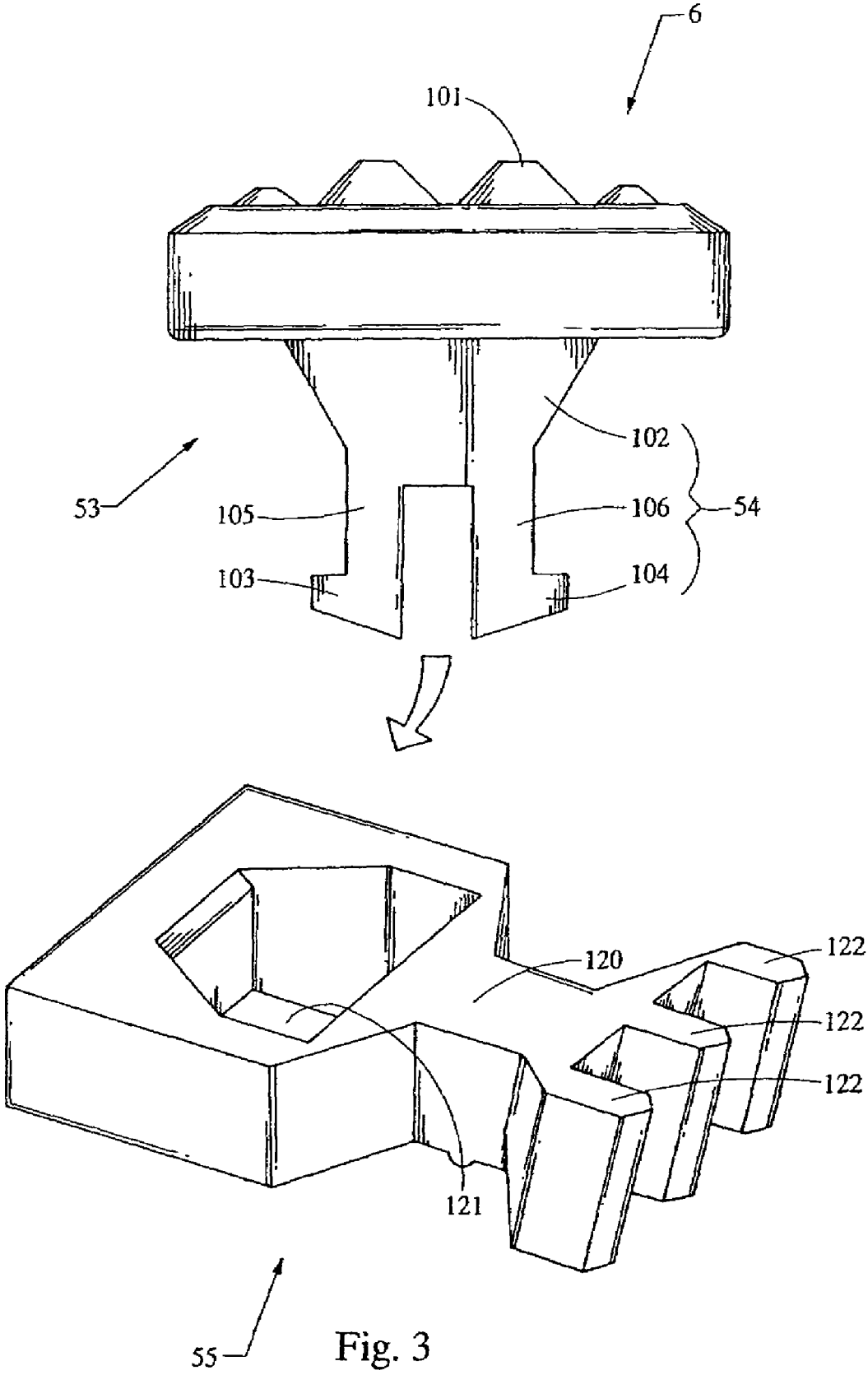
FIG. 3 depicts a detailed view of a lock assembly.

FIG. 3 shows a detailed view of the lock assembly 53 prior to engagement of the first lock member 54 and the second lock member 55. The first lock member 54 includes the lock button 6, a body member 102 and a pair of legs 105, 106. The lock button 6 has a plurality of tactile bumps 101 that allow the user to operate the lock button 6 easily. The bumps 101 prevent fingers of the user from slipping on the surface of the lock button 6 during the operation of the button 6. Alternatively, the bumps 101 allow the user to easily slide the lock button 6. The body member 102 is downwardly tapered in FIG. 3, but other shapes and designs are available. The pair of legs 105, 106 includes locking flanges 103, 104 on their ends. The flanges 103, 104 extend in a direction perpendicular to the legs 105, 106. More specifically, the flange 104 extends proximally to the second gear 60, whereas the flange 103 extends distally from the second gear 60.

Figure 4A:
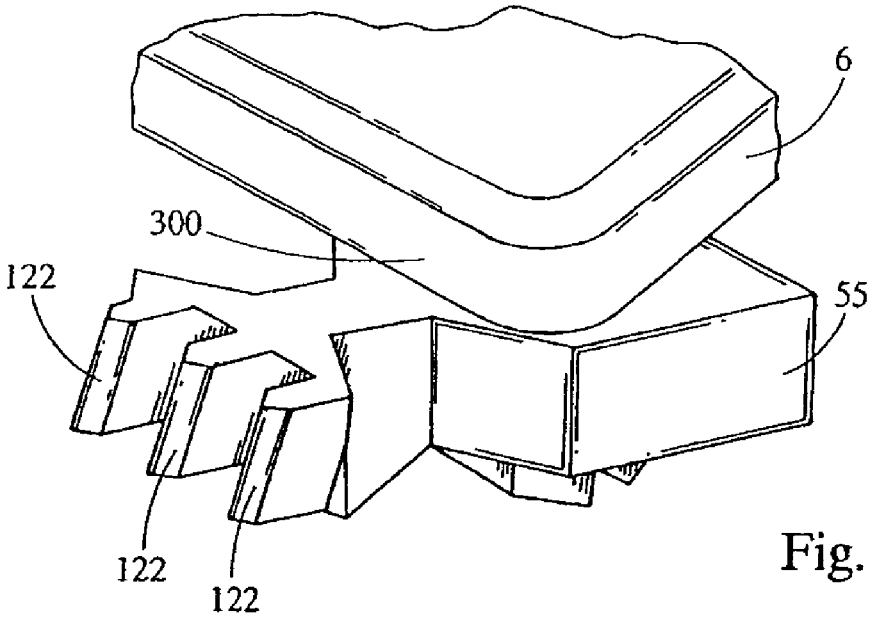
FIGS. 4A-4C depict an operation of the lock assembly in cooperation with the gear assembly.
Figure 4B:
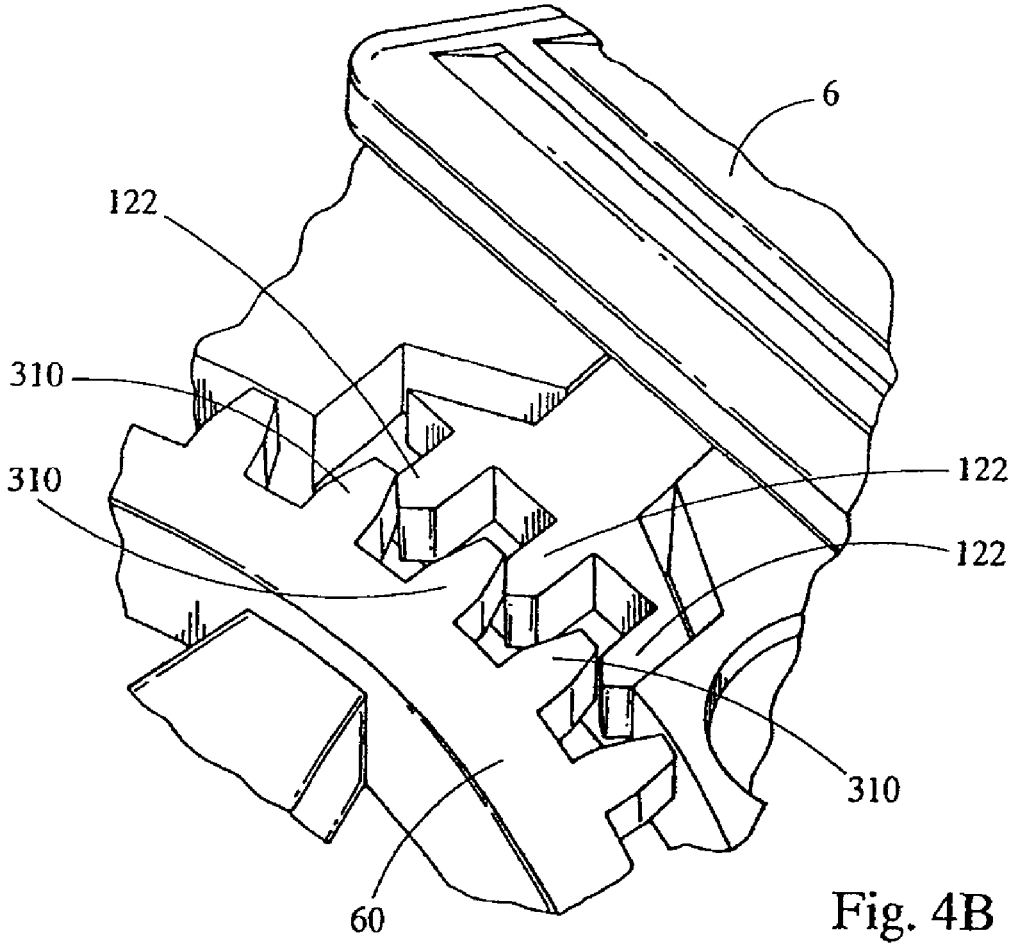
Figure 4C:
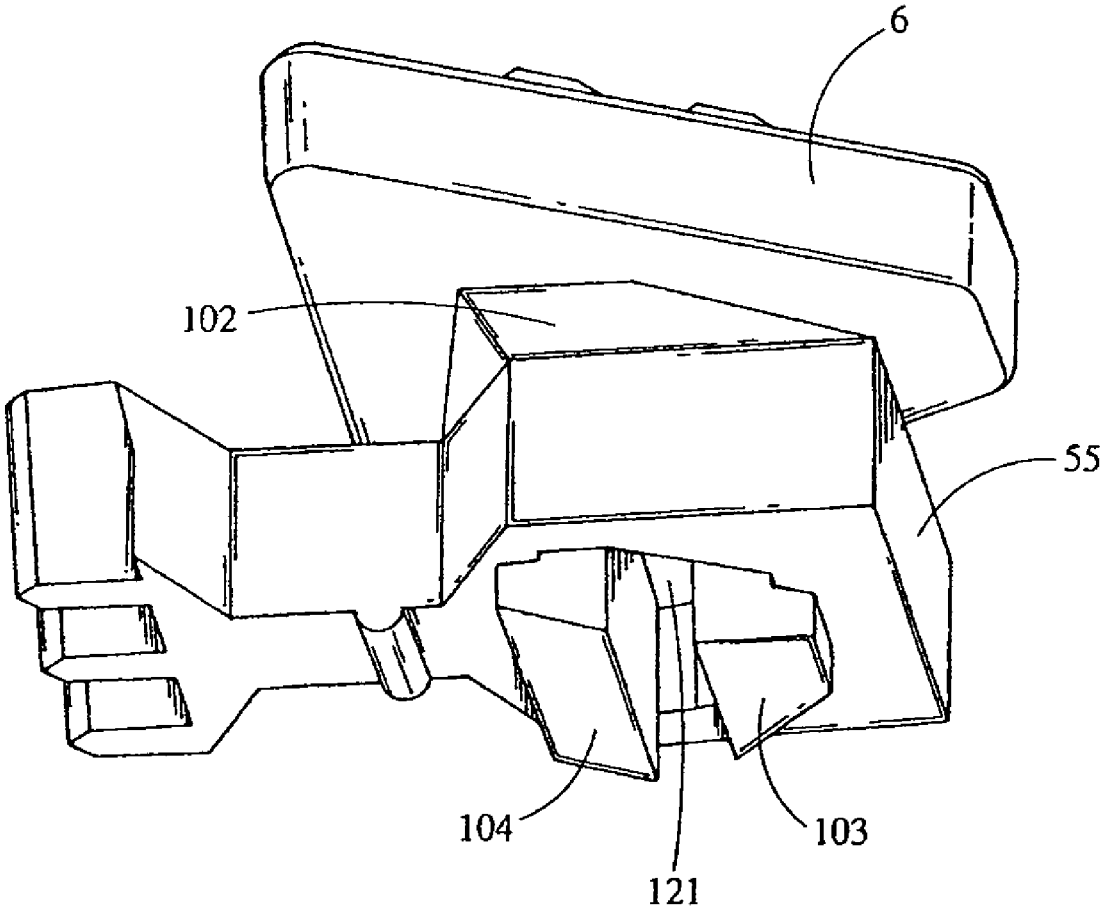

The second lock member 55 includes an opening 121, a body 120 and a plurality of teeth 122. The plurality of teeth 122 is disposed on a proximal end to the second gear 60. Through the opening 121, the second lock member 55 engages the first lock member 54. Specifically, the flanges 103, 104 secure the first lock member 54 to lockingly engage with the second lock member 55 as shown in FIG. 4C. The lock button 6 is connected to the second lock member 55 by means of the body member 102 and the pair of legs 105, 106. This makes it possible that the lock button 6 is located outside of the housing 10 and that the second lock member 55 is located at the same level as the second gear 60 within the housing 10. The lock button 6 is exposed outside of the housing 10. On the other hand, the second lock member 55 is located adjacent the second gear 60 for performing the locking function. Referring to FIG. 2A, the locking assembly 53 is located adjacent the second gear 60, but it may be located adjacent the first gear 59.

In one embodiment, the lock assembly 53 operates as follows. The user may slide the lock button 6 toward the second gear 60. In response to the movement of the lock button 6, the second lock member 55 slides toward the second gear 60 and the teeth 122 of the second lock member 55 engage the second gear 60. Referring to FIG. 2A, a sliding track 56 is formed beneath the second lock member 55 to facilitate this sliding movement. Due to the sliding movement of the second lock member 55, the second gear 60 is locked by the teeth 122, thereby consequently locking the extended line 74. To unlock the line 74, the user slides the lock button 6 back toward the opposite direction. The second lock member 55 slides back along the sliding track 56 and the second gear 60 is released from the engagement with the second lock member 55. As a result, the line 74 is unlocked.

Alternatively, the lock assembly 53 may operate by pressing the lock button 6 at one end. Specifically, to lock a position of the extended line 74, the lock button 6 is pressed downwardly on the proximal end to the second gear 60 as shown in FIG. 4A. The second lock member 55 is initially disposed slightly above the teeth 310 of the second gear 60. Also, the second lock member 55 is vertically in line with the teeth 310 of the second gear 60. By pressing the lock button 6 on the proximal end, the teeth 122 of the second lock member 55 and the teeth 310 of the second gear 60 overlap and engage as shown in FIG. 4B. The second gear 60 does not rotate and is held stationary, which subsequently holds the rotation of the first gear 59 and the spool 78. Accordingly, the locking function is accomplished.

To unlock the extended line 74, the lock button 6 is pressed downwardly on a distal end from the second gear 60 as shown in FIG. 4C. In response to the movement of the lock button 6, the second lock member 55 moves slightly upwardly from the second gear 60 and eventually, disengages from the teeth 310 of the second gear 60. The second gear 60 is freed from the second lock member 55, and unlocking of the extended line is accomplished.

Although the various embodiments of the invention have been described in connection with a chalk line device, the invention is not so limited. For example, the invention may also be applicable to other devices that involve a locking assembly and/or a gear assembly, such as tape measuring devices.

The various embodiments of the invention have been explained, but they do not represent the scope of the invention. For example, it may be apparent to those having ordinary skill in the art that modifications and changes may be made with the invention. It is therefore intended in the appended claims to cover all such changes and modifications that fall within the true spirit and scope of the invention.

I claim:

1. A chalk line device comprising a housing including a gear cavity and a chalk cavity, a chalk line, and a spool for retaining the chalk line and disposed in the chalk cavity, the chalk line device comprising: a first helical gear disposed in the gear cavity; a second helical gear disposed in the gear cavity and engaging the first helical gear; a handle for rotating the first helical gear and the second helical gear; a locking assembly separate from said handle and comprising a lock member that releasably engages with one of the first or the second helical gears as it is moved between a first position and a second position to lock said first and second helical gears in a stationary position.

2. A chalk line device comprising a housing including a gear cavity and a chalk cavity, a chalk line and a spool for retaining the chalk line and disposed in the chalk cavity, the device comprising: a stationary gear rest including a shaft extending from the gear rest; a clutch mounted over and movable relative to the shaft in a first direction and a second direction, said clutch being biased in the first direction away from the gear rest; a first helical gear disposed in the gear cavity and connected to the spool; a second helical gear disposed in the gear cavity and engaging the first helical gear said gear rest including a first portion on which the second helical gear rests, said second helical gear including a central opening and said clutch arranged in said central opening such that said clutch is biased in the first direction such that it can assume a first position relative to said second helical gear where the clutch is engaged with said central opening of said second helical gear and said clutch movable in the second direction to a second position relative to said second helical gear where said clutch is disengaged from said central opening of said second helical gear, said clutch moving in said second direction on said shaft between said first position and said second position where said clutch occupies said second position when it is pressed in said second direction.

3. The chalk line device of claim 2 wherein said first helical gear has a first diameter; and, said second helical gear has a second diameter; and, wherein the first helical gear and the second helical gear have a predetermined gear ratio, m:n, m being a number of turns of the second helical gear and n being a number of turns of the first helical gear in response to m; and, wherein the second diameter is larger than the first diameter.

4. The chalk line device of claim 3, wherein m is one and n is six.

5. The chalk line device of claim 2, further comprising a a clutch button member operably connected to the clutch and pressed in the second direction to allow the clutch to disengage from the second helical gear; and a rotatable handle attached to the clutch button member for rotating the second helical gear.

6. The chalk line device of claim 5, further including a clutch housing wherein the handle and the clutch button member are located outside of the clutch housing.

7. The chalk line device of claim 5, further comprising a spring member disposed adjacent the central opening of the second helical gear and acting in cooperation with the clutch and the second helical gear.

8. The chalk line device of claim 7, wherein the spring member is disposed along a channel disposed vertically between the clutch button member and the clutch and inside of the clutch housing.

9. The chalk line device of claim 7, wherein the spring member is compressed when the clutch button member is pressed downwardly.

10. The chalk line device of claim 2, further comprising a locking assembly that engages one of the first helical gear or the second helical gear.

11. The chalk line device of claim 10, wherein the lock assembly includes a lock button.

12. The chalk line device of claim 11, wherein the lock button comprises a plurality of bumps disposed on a top surface thereof.

* * * * *